United States Patent [19]

Boundy et al.

[11] 4,013,254

[45] Mar. 22, 1977

[54] MOUNTING CLIP LOCK

[75] Inventors: Bruce K. Boundy, Holland; Robert J. Munsey, Grand Rapids, both of Mich.

[73] Assignee: Westinghouse Electric Corporation, Pittsburgh, Pa.

[22] Filed: Jan. 7, 1976

[21] Appl. No.: 647,028

[52] U.S. Cl. ..... 248/243; 211/107; 248/224.4; 248/223.3; 312/245; 312/263

[51] Int. Cl.[2] ..... A47G 29/02; A47F 5/08

[58] Field of Search ..... 52/632, 728; 211/192, 211/107; 248/220.5, 224, 243; 312/245, 263; 108/152

[56] References Cited

UNITED STATES PATENTS

| | | | |
|---|---|---|---|
| 2,932,368 | 4/1960 | Schell, Jr. | 211/192 |
| 3,299,839 | 1/1967 | Nordabak | 108/152 |
| 3,353,684 | 11/1967 | Chesley | 248/243 |
| 3,702,137 | 11/1972 | Evans | 211/192 |
| 3,828,937 | 8/1974 | Nash | 248/243 |
| 3,877,191 | 4/1975 | Munsey | 52/632 |

*Primary Examiner*—Casmir A. Nunberg
*Attorney, Agent, or Firm*—B. R. Studebaker

[57] ABSTRACT

A locking mechanism for locking a backless wall mounted cabinet or the like to a wall panel or partition having a pair of spaced slotted standards thereon adapted to receive a plurality of equidistantly spaced linearly aligned hook-shaped tabs on the rearward edges of the cabinet side walls. The locking mechanism includes a locking tab having a pair of spaced detents thereon, which locking tab is slidable from a first position adapted to enter the slots in the slotted standard with the hook-shaped tabs to a second position which locks the hook-shaped tabs into the slotted standard. A spring-urged locking pin is constructed and arranged to retain the locking tab in its second position.

3 Claims, 4 Drawing Figures

MOUNTING CLIP LOCK

BACKGROUND OF THE INVENTION

This invention relates generally to the securing or locking of hook-shaped mounting tabs into a slotted standard and more particularly to accomplishing that function in connection with a cabinet or other accessory to be mounted on a wall panel or partition.

In recent years there has been an increasing popularity for the concept of open office planning which utilizes free standing partition systems for defining various office and work station areas. Almost all of the manufacturers of these type systems provide for the direct mounting of office accessories such as cabinets, shelves, work surfaces and the like directly to the free standing partition or wall. Many of these systems employ what is known in the trade as a slotted standard as a part of the wall panel or partition to serve as a mounting vehicle on that wall panel or partition. The slotted standard is generally a vertical steel chanel which extends over the entire vertical dimension of the panel and has therein a plurality of equidistantly spaced, vertically aligned slots which are adapted to receive a plurality of hook-shaped or T-shaped connector elements which extend from the back surface of the accessory to be mounted to the wall panel. Illustrations of the hook-type connector may be found in U.S. Pat. No. 3,877,191 for Connector Assembly and Support Post, issued to Robert J. Munsey and the T-shaped connector is illustrated in U.S. Pat. No. 3,771,847 for Over the Cabinet Door Assembly, issued to Milo Aylworth.

It will be readily apparent that heavy accessories such as cabinets, sometimes loaded with heavy materials such as books, or work surfaces and book shelves are retained in their mounted position only by virtue of the vertical load provided by the accessory itself. It should be equally apparent that an inadvertent jarring or accidental removal of the hook-shaped or T-shaped connectors from the slotted standard could result in a serious accident.

Another problem with this type mounting system can be illustrated with reference to the above-cited U.S. Pat. No. 3,771,847, which discloses a backless wall mounted cabinet, which could obviously incorporate a provision for locking the cabinet door. The security of such a locked cabinet is clearly fictitious in that the cabinet can be readily removed from the wall and entered from the rear regardless of the locked door. Providing a locking mechanism in connection with the hook-shaped or T-shaped connector elements in order that any wall mounted accessory can have its mounting hooks locked into the slotted standard and which locking mechanism can only be released through positive action as opposed to inadvertent actuation can eliminate the hazard of such wall mounted accessories accidently falling from the wall. Additionally, providing the deactivating element of the locking mechanism on an internal surface of a wall mounted cabinet precludes the removal of the cabinet from the wall when the cabinet door is in a locked configuration.

Several mechanisms have been disclosed for locking hook-shaped connectors into slotted standards, for example, U.S. Pat. No. 3,601,432 to Fenwick discloses a swingable latch-type member for this purpose, and U.S. Pat. No. 3,794,281 to Munsey discloses a flip-type latch member for a similar purpose. Additionally, Application Ser. No. 548,128, filed Feb. 7, 1975, by Bruce K. Boundy for a cantilever lock now issued as U.S. Pat. No. 3,966,158 and owned by the assignee of this invention, discloses a similar type latching mechanism for locking cantilevered work surface supports which operate on a similar principle but lacks the positive locking means of this invention.

SUMMARY OF THE INVENTION

The locking mechanism of this invention for securing an element to a slotted standard having a plurality of linearly aligned equidistantly spaced slots therein involves complementary tab clips on the element which include linearly aligned, equidistantly spaced hook-spaced tabs constructed and arranged to enter the slots in the slotted standard. A locking tab is mounted for limited slidable movement on the element, which locking tab includes at least one detent extending therefrom which is linearly aligned with the hook-shaped tabs and is slidable between a first position in which the at least one detent is spaced from the hook-shaped tabs a distance equivalent to a multiple of the equidistant spacing of the tabs and a second position which is different from any multiple of the equidistant spacing. The locking mechanism further includes a locking pin which is spring-urged against the locking tab and adapted to seat in an aperture in the locking tab to retain that tab in its second, locked position.

The locking mechanism of this invention, when employed in combination with a backless wall mounted cabinet, which includes the plurality of linearly aligned equidistantly spaced hook-shaped tabs extending from the rearward edge of each side wall of the cabinet, locates the spring-urged locking pin on the interior surface of the side wall thereby making the de-activating portion of the locking mechanism inaccessible when the front or door of the cabinet is locked.

BRIEF DESCRIPTION OF THE DRAWINGS

The principle features and many of the attendant advantages of the present invention will become more readily apparent and better understood as the following description is considered in connection with the accompanying drawings in which.

DESCRIPTION OF THE PREFERRED EMBODIMENT

Figure 1:
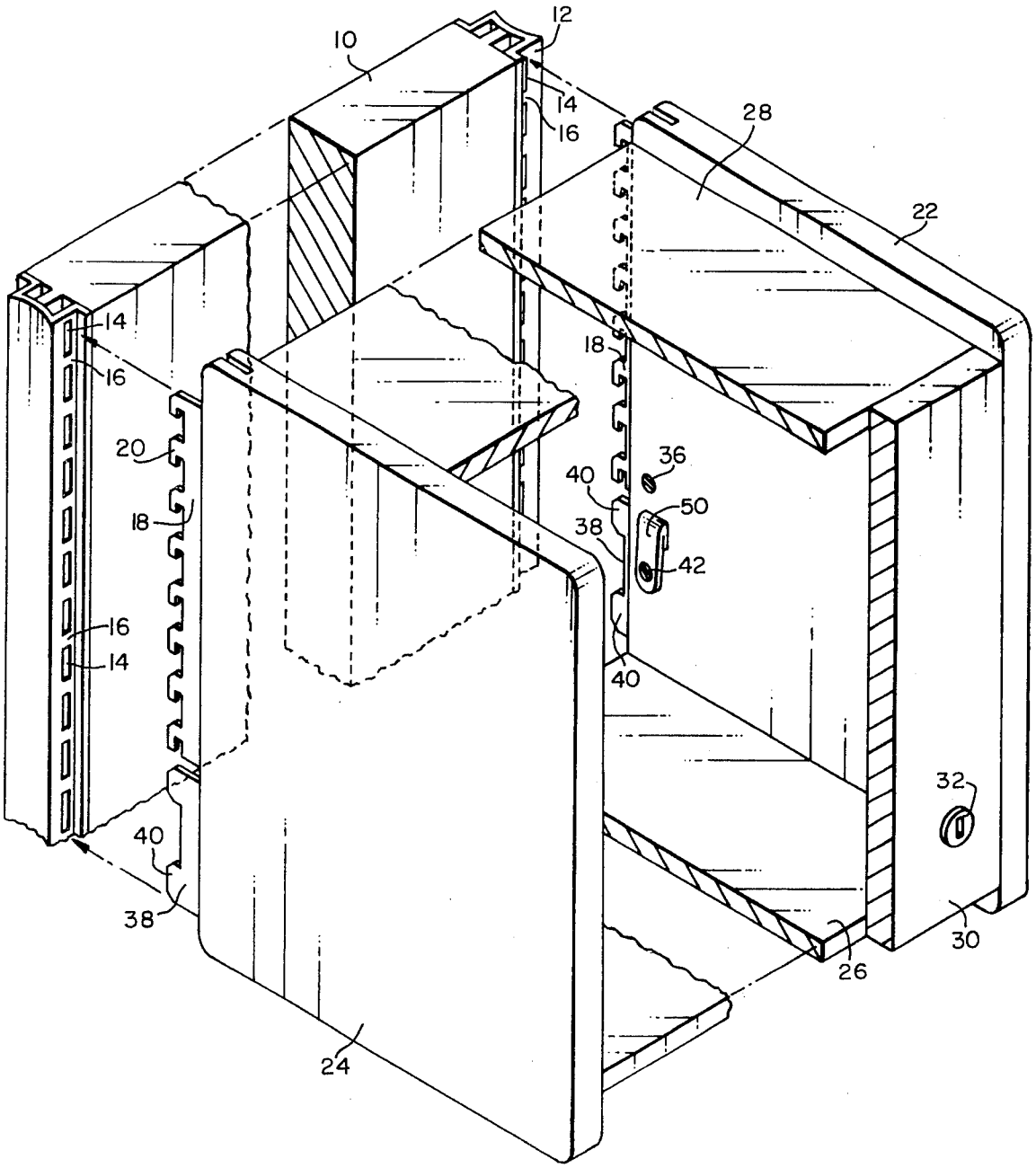
FIG. 1 is an isometric view of the locking mechanism of this invention employed in connection with a wall mounted cabinet.

Referring now in detail to the drawings wherein like reference characters represent like parts throughout the several views, there is illustrated in FIG. 1 the locking mechanism of this invention in connection with a typical wall-hung cabinet. A common vehicle for mounting wall-hung accessories to partitions or wall panels is a steel channel known in the trade as a slotted standard. In FIG. 1 there is illustrated a typical wall panel 10 having a slotted standard 12 secured to each end thereof. The slotted standard generally includes a plurality of linearly aligned equidistantly spaced slots 14 on at least one edge thereof. The slots 14 are separated by spacer portions 16. In order to mount an accessory, as for example a cabinet, work surface, book shelf or the like, to a wall panel having a slotted standard thereon, a tab clip 18 having linearly aligned equidistantly spaced hook-shaped or T-shaped tabs 20 extending therefrom are generally employed. These tab clips and their associated hook-shaped or T-shaped tabs enter into the slots and through a downward movement of the tab and associated accessory the hooks or T's 20 move behind the spacer portions 16 to secure the accessory to the wall panel. The tab clips 18, as illustrated in FIG. 1, are connected to a wall mounted cabinet including side walls 22 and 24, a bottom wall 26, a top wall 28 and a door or closure 30 which includes therein a lock 32 to secure the cabinet when desired.

It will be apparent that the conventional interconnection of the hook-shaped tabs 20 on the tab clip 18 with the slotted standard 12 can be readily disengaged by merely lifting the cabinet and removing the tabs 20 from the slots 14. This can be done intentionally and if the cabinet door 30 is locked, for example by the lock 32, the accessibility of the contents of the cabinet will be apparent by simply removing the entire cabinet from the wall. Additionally, the cabinet could be inadvertently bumped and the hook-shaped tabs removed from their position behind the spacer portions 16 permitting the cabinet to fall, causing either property damage to the cabinet or physical damage to the person. The locking mechanism of this invention is intended to prevent either of these possibilities from occurring.

Figure 2:
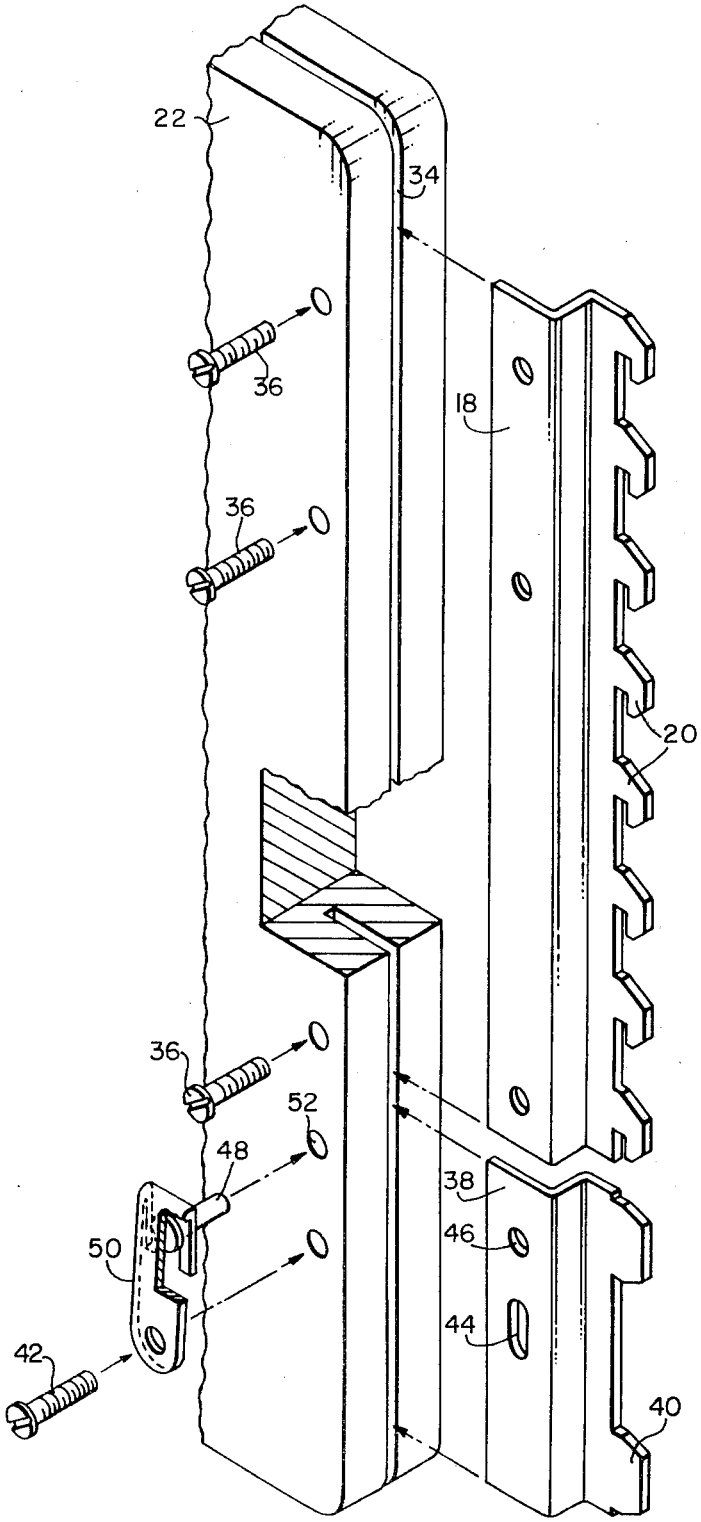
FIG. 2 is an exploded view of the locking mechanism of this invention.

As best illustrated in FIG. 2, the tab clip 18 is secured in a slot 34 in the side wall 22 and/or 24 of the cabinet by means of a plurality of threaded screw members 36. It will be apparent, however, that the tab clip 18 may be secured to the accessory in any of several conventional means. The locking mechanism of this invention includes a locking tab 38 having a pair of detents 40 extending therefrom with the locking tab also mounted in the slot 34 by means of a screw member 42 which extends through an elongated slot 44 in the locking tab 38. The locking tab 38 is also provided with an aperture 46 which is adapted to receive a locking pin 48 mounted on a leaf spring 50. The leaf spring 50 is secured to the side wall 22 by means of the screw member 42 with the locking pin 48 extending into a hole 52 in the side wall 22 so that the end of the locking pin 48 contacts the locking tab 38.

Figure 3:
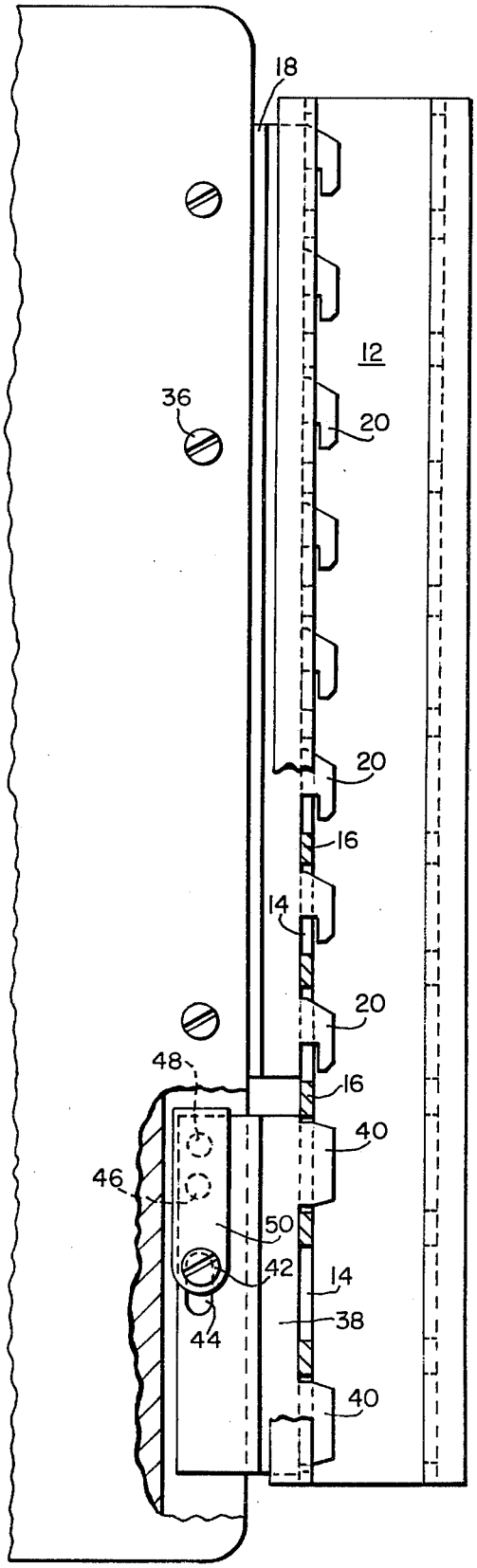
FIG. 3 is a side elevational view, partly in section, of the locking mechanism of this invention in its unlocked position.
Figure 4:
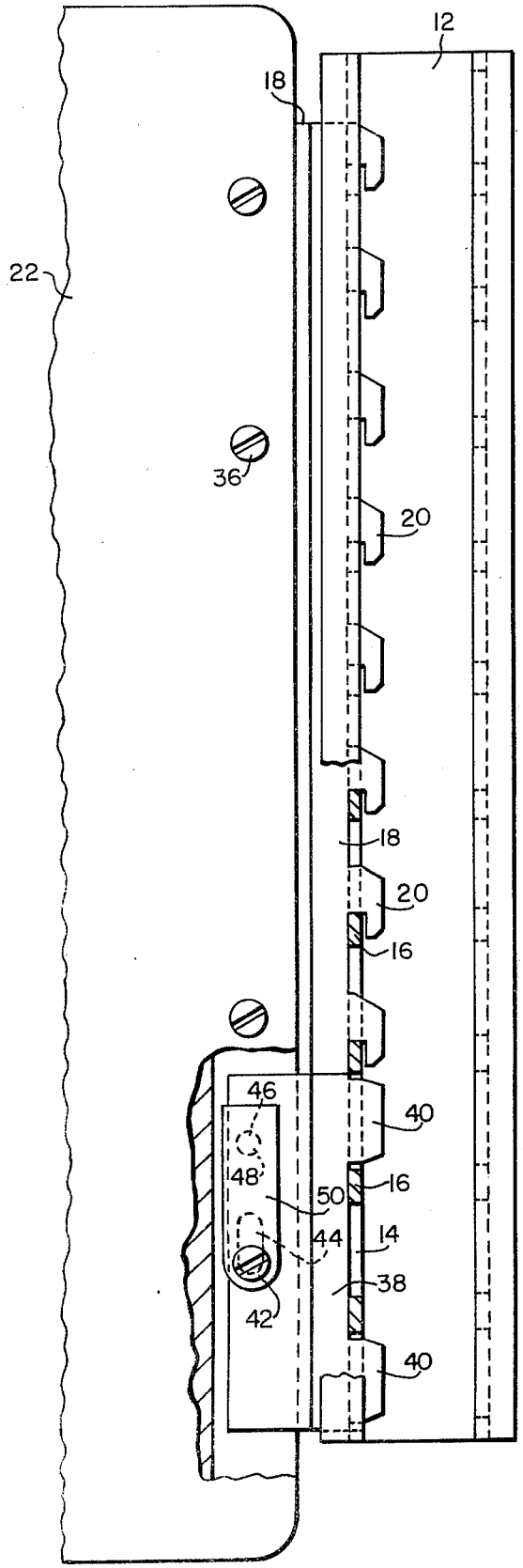
FIG. 4 is a side elevational view, partly in section, of the locking mechanism of this invention in a locked position.

The operation of the locking mechanism of this invention is best illustrated in FIGS. 3 and 4. As will be seen in FIG. 3, the hook-shaped tabs 20 enter the slots 14 in the slotted standard 12 and at the same time, with the locking tab 38 in its downward position, i.e., that position wherein the screw member 42 is in the uppermost extent of the slot 44, the detents 40 will also enter slots 14. In this first position the detents 40 will be spaced from the hook-shaped tabs 20 a distance which is a multiple of the equidistant spacing between the hook-shaped tabs 20 which will therefore permit each of the detents 40 to also enter one of the slots 14 in the slotted standard. When the accessory, or more particularly the cabinet illustrated in FIG. 1, is moved downwardly to cause the hook-shaped tabs to seat behind the spacer portion 16 in the slotted standard, the locking tab 38 will remain stationary in the slotted standard, causing the screw member 42 to move to a second position in the lower extent of the elongated slot 44, thus positioning the locking pin 48 over the aperture 46 into which it will drop under the urging of spring 50 as illustrated in FIG. 4. This movement upsets the equidistant multiple relationship between the hook-shaped tabs 20 and the detents 40 and the tab 38 is now locked with respect to the tab clip 18 and the associated side wall 22 by means of the locking pin 48 entering the aperture 46. In this second position the interaction of the detents 40 with the slots 14 will prohibit the raising of the accessory and more specifically, the hook-shaped tabs 20 from behind the spacer portions 16 rendering the accessory secure to the wall panel.

When it is desired to remove the accessory, or more particularly the cabinet, the leaf spring 50 is manually pulled away from the cabinet wall 22 removing the locking pin 48 from the aperture 46 and thus permitting the locking tab 38 to be slidable in the slot 34. In this position the hook-shaped tabs 20 can be raised from behind the spacer portions 16 and the cabinet removed from the wall panel.

Referring again to FIG. 1, it will be seen that the leaf spring 50 and associated locking pin 48 may be disposed on an inner surface of the side walls 22 and 24 of the cabinet. When the locking mechanism leaf spring is so located and the cabinet door 30 is locked by means of the lock 32, the cabinet is not only secure from entering through the cabinet door 30, but is also locked to the wall and cannot be removed therefrom to permit rear entry since the locking pin release is now confined within the locked cabinet.

It will be apparent from the foregoing that the locking mechanism of this invention may be employed for securing other types of wall mounted accessories to a wall panel or partition employing a slotted standard to receive hook-shaped connectors or tabs. The locking pin 48, when spring-urged through leaf spring 50 into the aperture 46 in the locking tab 38, can only be removed by positive action and in effect a two-step operation is required to remove the accessory from the wall panel. First, the leaf spring 50 must be held out of engagement with the aperture 46 and then the entire accessory must be raised to permit the hook-shaped tabs to be removed from the slots 14 in the slotted standard 12.

We claim:

1. A locking mechanism for securing an element to a slotted standard, said slotted standard having a plurality of linearly aligned equidistantly spaced slots therein; said element comprising a body member, a tab clip having a plurality of linearly aligned equidistantly spaced hook-shaped tabs fixed to said body member and extending from at least one edge thereof, said hook-shaped tabs being constructed and arranged to enter the slots in said slotted standard and be hooked thereinto; a locking tab mounted for limited slidable movement on said body member, said locking tab including at least one detent extending therefrom and linearly aligned with said hook-shaped tabs, said locking tab being slidable between a first position wherein said at least one detent is spaced from said hook-shaped tabs a distance equivalent to a multiple of said equidistant spacing and a second position different from any multiple of said equidistant spacing; said locking tab further including an aperture therethrough, and a locking pin and spring combination, said spring continuously urging said locking pin against said locking tab whereby when said locking tab is in said second position, said locking pin is urged into said aperture thereby securing said locking tab in said second position.

2. The locking mechanism according to claim 1 wherein said spring means is a leaf spring.

3. In combination with a backless wall mounted cabinet having a plurality of equidistantly spaced linearly aligned hook-shaped tabs extending from the rearward edge of each side wall of said cabinet adapted to be mounted to a pair of parallel slotted standards having equidistantly spaced linearly aligned slots therein, the improved locking mechanism which comprises;

a locking tab extending from the rearward edge of at least one of said side walls, said locking tab being slidable with respect to said side wall and including at least one detent extending therefrom linearly aligned with said hook-shaped tabs, said locking tab being slidable from a first position simulating the spacing between said equidistantly spaced hook-shaped tabs to a second position upsetting that relationship, said locking tab further including an aperture therethrough; and means for releasably locking said locking tab in said second position, said means including, in combination, a locking pin and a leaf spring, said leaf spring urging said locking pin into contact with said locking tab whereby when said locking tab is in said second position said leaf spring urges said locking pin into said aperture thereby releasably locking said locking tab in said second position.

* * * * *